US005562262A

United States Patent [19]

Pennell

[11] Patent Number: 5,562,262

[45] Date of Patent: Oct. 8, 1996

[54] TAPE DISPENSER

[75] Inventor: Jack F. Pennell, Sutton Coldfield, United Kingdom

[73] Assignee: Ryford Limited, West Midlands, United Kingdom

[21] Appl. No.: 345,528

[22] Filed: Nov. 28, 1994

[30] Foreign Application Priority Data

Nov. 27, 1993 [GB] United Kingdom ..... 9324436

[51] Int. Cl.[6] ..... B65H 16/00; B44C 7/00

[52] U.S. Cl. ..... 242/588.3; 242/588.6; 242/615.2; 156/577

[58] Field of Search ..... 242/588.6, 588.3, 242/615.2, 615.4; 156/577

[56] References Cited

U.S. PATENT DOCUMENTS

| | | | |
|---|---|---|---|
| 1,076,635 | 10/1913 | Howard | 242/588.6 |
| 2,825,450 | 3/1958 | Lambert | 242/588.6 X |
| 2,916,228 | 12/1959 | Wellington | 242/615.2 X |
| 3,122,334 | 2/1964 | Nebash | 242/588.6 |
| 3,125,263 | 3/1964 | Harbour | 225/51 |
| 3,140,217 | 7/1964 | Harbour | 156/577 |
| 3,156,603 | 11/1964 | Robinson | 156/577 |
| 3,740,297 | 6/1973 | Vidinsky | 156/523 |
| 3,814,643 | 6/1974 | Wagner | 156/71 |
| 3,935,758 | 2/1976 | Polzin et al. | 81/3 R |
| 3,969,180 | 7/1976 | Ravesloot | 156/523 |
| 4,067,510 | 1/1978 | McGonagle | 242/55.2 |
| 4,441,133 | 4/1984 | Ogawa et al. | 242/615.2 |
| 4,623,421 | 11/1986 | Cardin | 156/577 X |
| 4,792,375 | 12/1988 | Lin | 242/588.6 X |
| 4,978,085 | 12/1990 | Letourneau | 242/588.3 |
| 5,316,614 | 5/1994 | Phillips | 156/574 |

FOREIGN PATENT DOCUMENTS

| | | |
|---|---|---|
| 0459654 | 12/1991 | European Pat. Off. . |
| 658849 | 12/1986 | Switzerland . |
| 2274448 | 7/1994 | United Kingdom . |
| 9309050 | 5/1993 | WIPO . |

OTHER PUBLICATIONS

Examiner's Search Report for Application No. EP 94 30 8706.

Examiner's Search Report for Application No. GB 9423775.7.

*Primary Examiner*—John Q. Nguyen

*Attorney, Agent, or Firm*—Webb Ziesenheim Bruening Logsdon Orkin & Hanson, P.C.

[57] ABSTRACT

A tape dispenser comprising a body having an engagement portion to engage a salient standing above a surface, a mounting to mount a reel of tape for rotation relative to the body and a guide to guide the tape so as to be dispensed from the body laterally adjacent said engagement portion.

11 Claims, 3 Drawing Sheets

FIG. 2
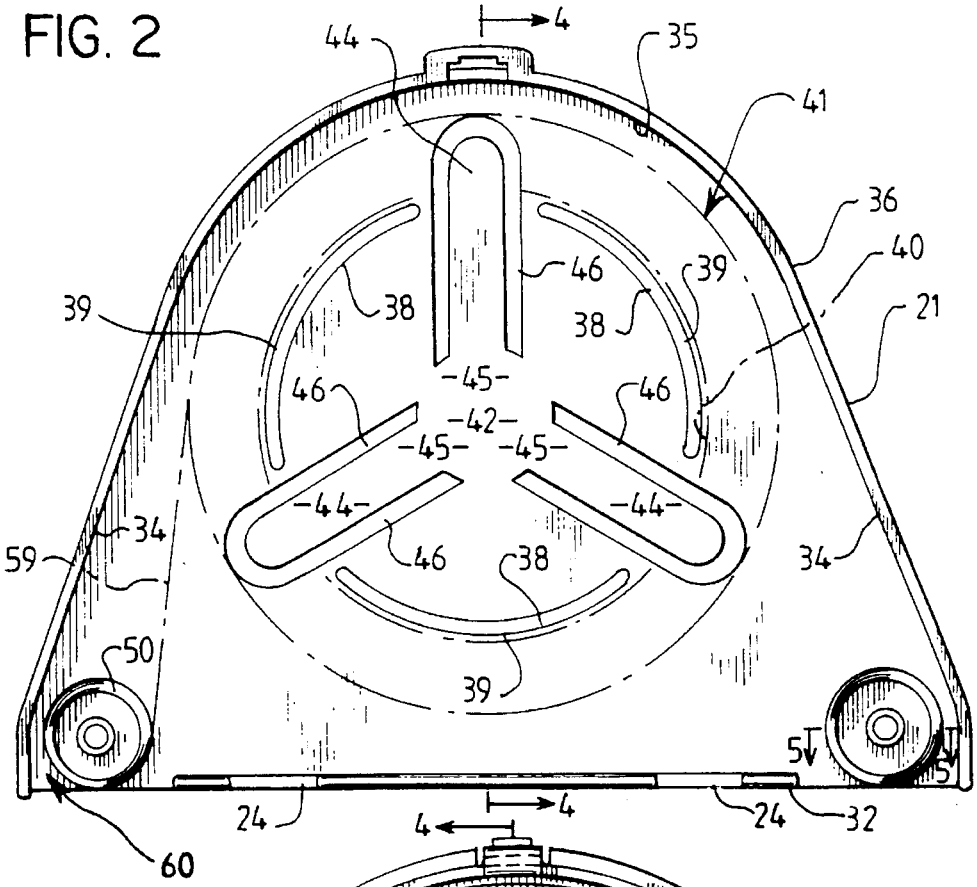
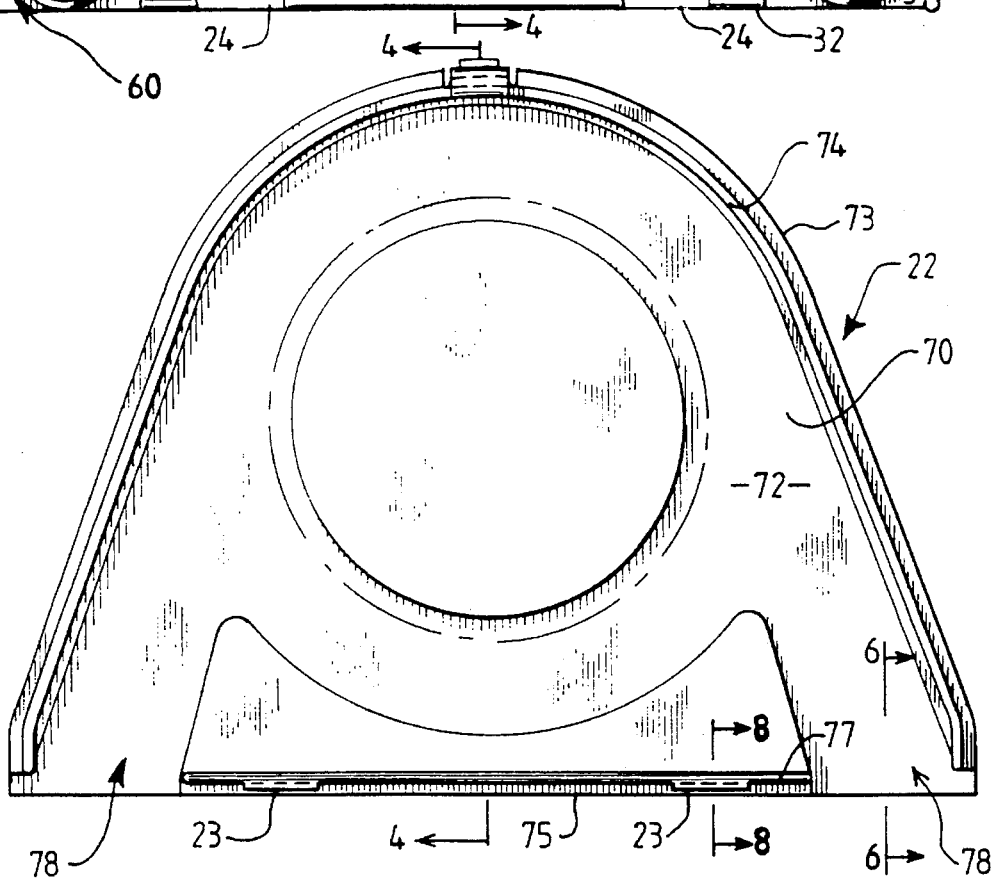
FIG. 3

FIG. 7
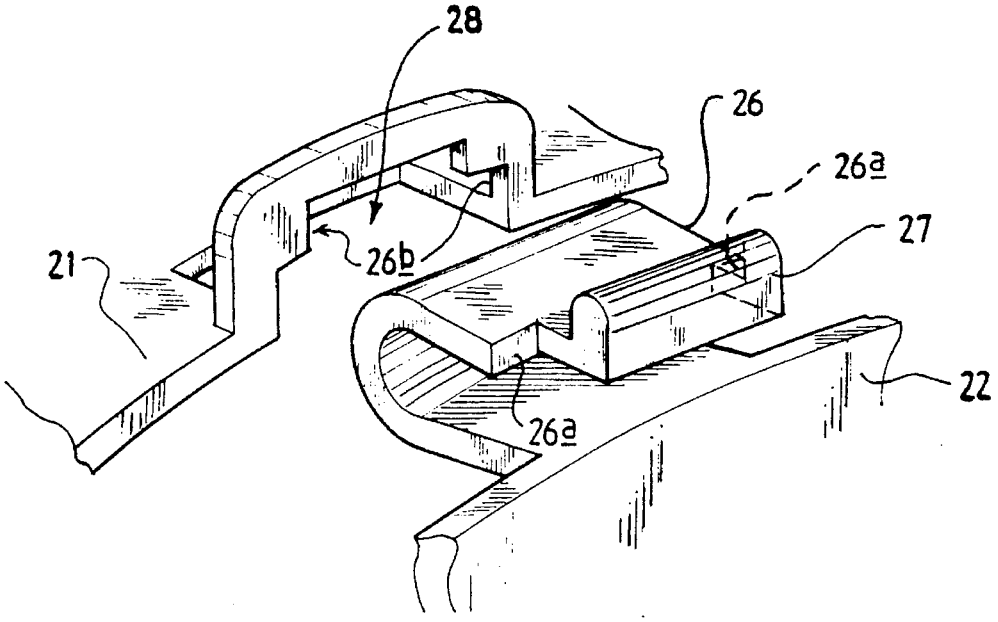
FIG. 8
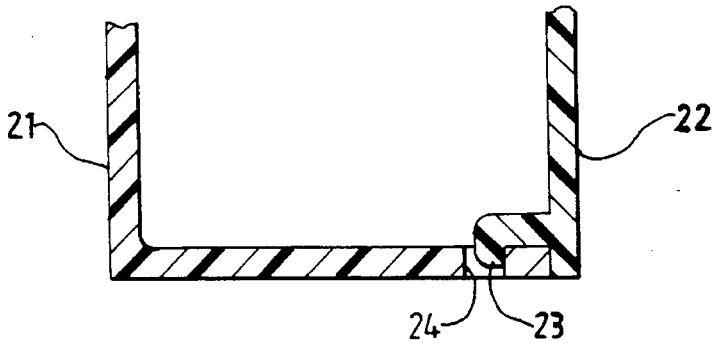
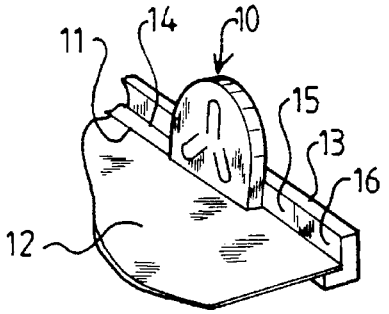
FIG. 9

TAPE DISPENSER

BACKGROUND TO THE INVENTION

This invention relates to a tape dispenser for dispensing tape from a reel of tape. The invention is particularly, but not exclusively, concerned with a tape dispenser for dispensing tape onto a surface closely adjacent to a salient standing above the surface. For example, to dispense masking tape onto part of a window which is closely adjacent to a frame of the window to prevent accidental marking of the window during painting of the frame.

SUMMARY OF THE INVENTION

An object of the invention is to provide a new and improved tape dispenser and more particularly a tape dispenser for dispensing tape onto a surface closely adjacent to a salient standing above the surface.

According to the present invention we provide a tape dispenser comprising a body having an engagement portion to engage a salient standing above a surface, means to mount a reel of tape for rotation relative to the body and guide means to guide the tape so as to be dispensed from the body laterally adjacent said abutment portion.

As a result the tape is dispensed onto the surface laterally adjacent said salient.

The means to mount the reel of tape may comprise reel engagement means adapted to engage with the inwardly facing surface of a reel of tape to guide the reel of tape for rotation about the central axis of the reel of tape.

The body may be provided with at least one resilient biasing means to engage a reel of tape and resiliently bias the tape towards the engagement portion.

The resilient biasing means may bias the tape into engagement with an abutment means which is laterally adjacent the engagement portion.

The body may comprise a hollow, relatively thin walled box within which said reel of tape may be mounted.

The engagement portion may comprise an outwardly facing surface of a wall of the body and the abutment means may comprise an inwardly facing surface of said wall of the body.

The body may comprise a base part and a lid part releasably secured together.

The lid and base parts may be releasably secured together by a resiliently biased catch on one part, preferably the lid, which is engageable with a detent on the other part.

The engagement portion and the abutment means may be provided on said lid part.

The resilient biasing means may comprise a plurality of leaf springs anchored at one end to the body.

The leaf springs may be free from the body except at one end where they are integral with the body.

The leaf springs may be anchored to a part of the body opposed to said retaining means and where the body comprises said base and lid parts the tongue may be anchored to the base part.

The body may be provided with a tapered guide means which urges the tape towards the engagement portion as the tape is dispensed.

The tapered guide means may comprise a tapered roller rotatable about an axis which extends away from the engagement portion and over which the tape is passed.

The roller may be of smaller diameter at the end of the roller which is closer to the engagement portion.

The roller may be rotatably mounted by bearing means carried by the base part of the body.

The body may be provided with a guide surface adapted to engage an edge of the tape as the tape is dispensed, said guide surface being disposed closely laterally adjacent to the engagement portion and facing in the opposite direction to the engagement portion.

The guide surface may comprise a portion of said abutment means provided by said inwardly facing surface of said wall of the body.

The guide surface may be tapered having its outer end spaced laterally closer to the engagement portion than its inner end.

The body may be provided with a reduced thickness in way of the reel of tape and the path of the tape from the reel for discharge.

Said reduced thickness may be provided by a recess in said inwardly facing surface of said wall of the body.

The body may be provided with two sets of said guide means and guide surface at opposite ends of the body so that the tape may be dispensed, alternately, from opposite ends of the body.

The body may be provided with a further engagement portion adapted to engage said surface. Said further engagement portion may extend perpendicularly away from the first engagement portion.

Said further engagement portion may be provided by an edge wall of the body and where the body comprises a base and lid part the base part may comprise a generally planar side wall bounded by an upstanding peripherally extending edge wall.

The tape may be dispensed from the body through an opening in said further engagement portion.

BRIEF DESCRIPTION OF THE DRAWINGS

An example of the invention will now be described with reference to the accompanying drawings, wherein:

FIG. 2 is a view of a base part of the dispenser of FIG. 1 taken in the direction of the arrow A but with a lid part removed;

FIG. 3 is a view of the lid part of the dispenser of FIG. 1 taken in the direction of the arrow B but with the base part removed;

FIG. 7 is a perspective view, to an enlarged scale, of the catch of the dispenser of FIGS. 1 to 6;

FIG. 8 is a section on the line 8—8 of FIGS. 2 & 3 but showing the parts assembled and to an enlarged scale, and FIG. 9 is an exploded fragmentary perspective view showing a tape dispenser embodying the invention in use.

DESCRIPTION OF THE PREFERRED EMBODIMENTS

Figure 4:
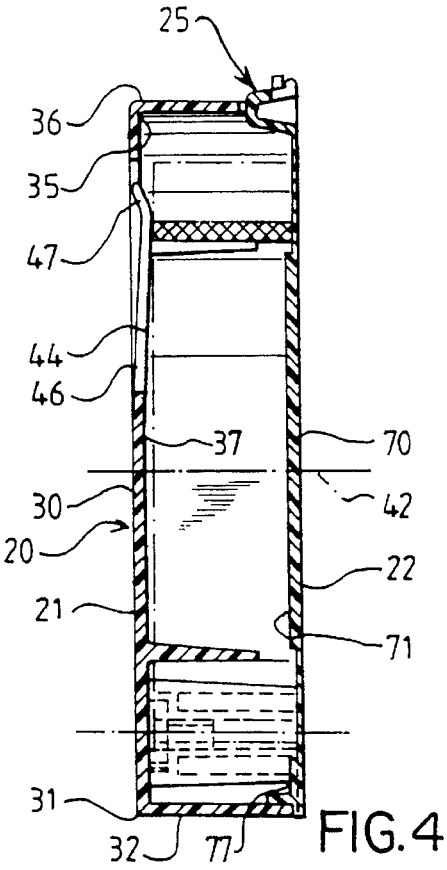
FIG. 4 is a section on the line 4—4 of FIGS. 2 and 3 showing the base and lid parts assembled.
Figure 1:
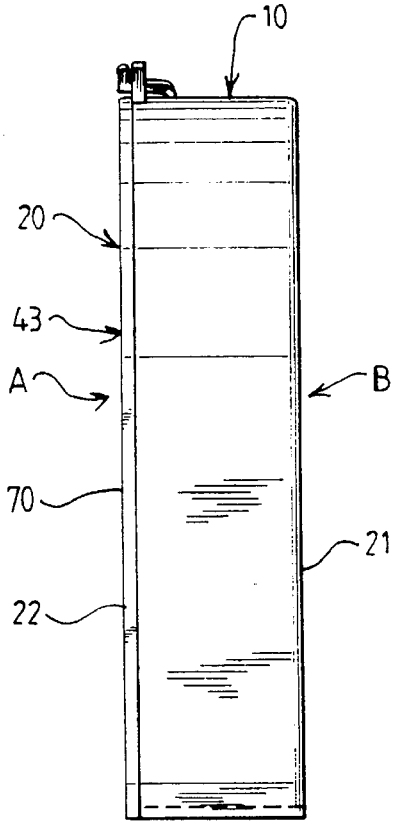
FIG. 1 is a side view of a tape dispenser embodying the invention.

Referring first to FIG. 9, a tape dispenser is indicated generally at 10 and is shown dispensing tape 11 onto a surface 12 such as a window pane supported in a frame 13.

In order to prevent accidental marking of the window pane 12 with paint when painting the window frame 13 the tape 11 which, in the present example comprises paper masking tape provided with a self-adhesive coating on the side thereof in contact with the surface 12 is dispensed from the dispenser 10 so as to abut with its one edge 14 a salient 15 provided by a shoulder of a rebate 16 of the frame 13.

It will be appreciated that it is desirable for the tape 11 to be dispensed so that it can conveniently be applied to the surface 12 with the edge 14 in contact with or very close to the salient 15 and the tape dispenser is constructed and arranged to facilitate this.

Referring now to FIGS. 1 to 8, the tape dispenser 10 comprises a body 20 having a base part 21 and a lid part 22 made as mouldings in suitable synthetic plastics material is best shown in FIGS. 4, 7 and 8 the base and lid parts are releasably secured together by means of a pair of tongues 23 provided on the lid part 22 which are received in openings 24 provided on the base part 21 together with a resilient catch means 25 comprising a resiliently displaceable catch 26 formed integrally with the lid and having a manually engageable portion 27 to permit shoulder **26*a* of the catch 26 to be displaced from retaining engagement with abutment parts 26*b* adjacent an aperture 28 provided on the base part 21**.

The base part 21 has a generally planar side wall 30 having a straight bottom edge 31 from which a bottom edge wall 32 extends at right angles. Extending perpendicular to the edge 31 at opposite ends are perpendicular portions 33 of the side wall 30 which terminate at planar upwardly and inwardly inclined portions 34 which merge with a part circular portion 35. A correspondingly shaped edge wall 36 is provided throughout the extent of the portions 33, 34 and 35 and this edge wall 36 is provided with the hereinbefore mentioned catch opening 28 whilst the catch openings 24 are provided in the bottom edge wall 32.

The side wall 30 has an inwardly facing surface 37 from which there extends reel mounting means comprising three part circular ribs 38 having an outer part circular surface 39 for abutment with the inwardly facing surface 40 (usually on a cardboard former) of a tape reel 41 housed within the body 20 to guide the tape reel 41 for rotation about a central axis 42 thereof.

The wall 30 is also provided with resilient biasing means to engage the tape reel 41 and bias it away from the wall 30 and towards an engagement portion 43 provided by an outwardly facing surface of the lid part 22, as hereinafter to be described in more detail. The resilient biasing means comprises three tongues 44 which are formed integrally with the remainder of the wall 30 at their one ends 45 but which are separated from the wall 30 throughout the rest of their extent by means of a generally U-shaped slot 46 and in addition the tongues 44 are inclined towards the hereinbefore mentioned engagement portion 43 from their ends 45 to a position adjacent their free ends where they are inclined away from the engagement portion 43 as shown at 46 and 47 respectively in FIG. 4.

Figure 5:
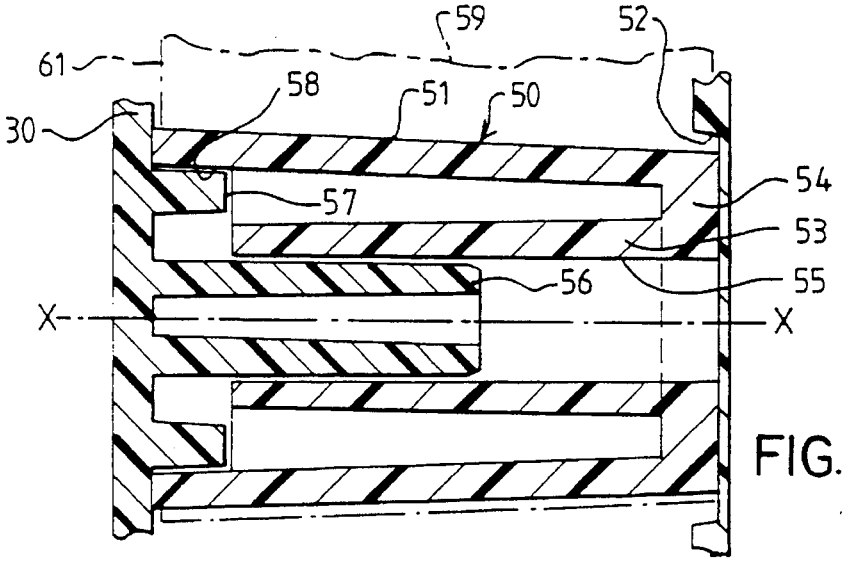
FIG. 5;is a cross-section on the line 5—5 of FIG. 2 to an enlarged scale.
Figure 6:
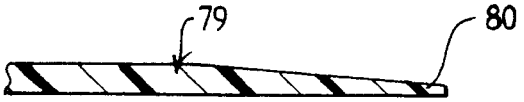
FIG. 6 is a section on the line 6—6 of FIG. 3.

As best shown in FIGS. 2 and 5, the base part 21 is provided with a guide roller 50. The guide roller 50, as best shown in FIG. 5, has an external surface 51 of frusto-conical configuration having a smaller diameter end 52 spaced furthest from the wall 30.

The roller 50 has a central boss portion 53 joined to the frusto-conical part 51 by a web part 54 and the boss part 53 has a central cylindrical bore 55 which is mounted for rotation on a spigot 56 upstanding from the wall 30. The wall 30 also has a cylindrical shoulder formation 57 upstanding therefrom for engagement with a part 58 of the frusto-conical part 50 of the roller so that the roller is mounted thereby for rotation about an axis X—X which is perpendicular to the wall 30.

As shown in FIG. 2, the tape 59 is fed from the reel 41 past one of the rollers 50, depending upon the end of the dispenser from which it is desired to dispense tape, and is then discharged from the body through an opening 60 provided by a gap in the bottom edge wall 32. The tape 59 is engaged by the frusto-conical surface part 51 of the roller and this serves to urge the tape 59 away from the wall 30.

The lid 22 comprises a generally planar wall 70 having an outwardly facing surface which provides the abutment portion 43 and an inwardly facing surface 71 which provides an abutment means against which the reel of tape 41 is urged by the fingers 44. The portion of the wall 70 engaged by the reel 41 and by the tape 59 in its path for discharge is made of minimum thickness consistent with necessary strength and is provided by a recess 72 provided in the surface 71. Around the periphery of the wall 70 is provided a shallow rib 73 having a groove 74 therein to receive the upper end of the edge wall 36 of the base part 21. Adjacent the bottom edge 75 of the lid part 22 is provided an upstanding flange 77 which carries the hereinbefore mentioned catches 23.

The portions 78 of the lid part 22 adjacent the opening 60 are provided with a tapered guide surface 79 having its minimum thickness at the outer end 80 thereof.

In use, the dispenser 20 is held in the hand of a user orientated so that the outwardly facing surface 43 of the lid part 22, which comprises an engagement portion, abuts the salient 15 provided by the shoulder 16 of the frame 13 and the dispenser is pressed against the salient, in addition the bottom edge wall 32, which comprises a further engagement portion, is pressed against the surface 12. Because of the combined effect of the fingers 44, tapered rollers 50 and guide surface 79, the tape 11 is dispensed so that it is very closely adjacent to the salient 15 as it leaves the dispenser and so can easily be manipulated onto the surface 12 in contact with, or very closely adjacent to, the salient 15, thereby facilitating masking operations.

The end of the dispenser from which the tape is dispensed can be chosen by a user in accordance with whether or not the user is left-handed or right-handed and also in accordance with the presence of obstructions at the end of a run. For example, in a conventional rectangular window frame a user may apply tape over a desired extent of window with the tape being dispensed from one end of the dispenser starting, for example, at the top of a vertical of the frame and then the lid can be removed by manipulating the catch 26 and the tape simply disengaged with one pair of tapered rollers and engaged with the other pair of tapered rollers so as to be discharged from the other end of the dispenser to enable tape to be applied to the remainder of the window adjacent the opposite end of the frame.

The features disclosed in the foregoing description, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A tape dispenser comprising a body having an engagement portion to engage a salient standing above a surface, a further engagement portion adapted to engage said surface and extending perpendicularly away from the engagement portion, said further engagement portion being provided by an edge wall of the body, an opening in said further engagement portion, through which the tape may be dispensed from the body, reel mounting means to mount a reel of tape for rotation relative to the body, guide means to guide the tape so as to be dispensed from the body through the opening laterally adjacent to the engagement portion, a tape discharge path extending from the reel of tape to the opening via the guide means, at least one resilient biasing means to engage the reel of tape and resilient bias the tape towards the engagement portion and bias the tape into engagement with an abutment which is laterally adjacent the engagement portion, the engagement portion comprising an outwardly facing surface of a wall of the body, and the abutment comprising an inwardly facing surface of said wall of the body, the guide means being tapered towards the engagement portion to urge the tape toward the engagement portion as the tape is dispensed, a guide surface adapted to engage an edge of the tape as the tape is dispensed, said guide surface being disposed laterally adjacent to the engagement portion and facing in a direction opposite to a direction in which the engagement portion faces and being located in the tape discharge path downstream of the guide means, the guide surface comprising a portion of said abutment, said guide surface being tapered and having an outer end of said guide surface spaced laterally closer to the engagement portion than an inner end of said guide surface.

2. A dispenser according to claim 1 wherein the reel mounting means comprises reel engagement means adapted to engage with an inwardly facing surface of a reel of tape to guide the reel of tape for rotation about the central axis of the reel of tape.

3. A dispenser according to claim 1 wherein the resilient biasing means comprises a plurality of leaf springs anchored at one end to the body.

4. dispenser according to claim 3 wherein the leaf springs each comprise a tongue which is free from the body except at one end where it is integral with the body.

5. A dispenser according to claim 1 wherein the body comprises a hollow, relatively thin walled box within which said reel of tape is mounted.

6. A dispenser according to claim 1 wherein the body is provided with a recess in said inwardly facing surface of said wall of the body to afford a reduced thickness adjacent the reel of tape and the path of the tape from the reel for discharge.

7. A dispenser according to claim 1 wherein the body comprises a base part and a lid part releasably secured together.

8. A dispenser according to claim 7 wherein the engagement portion and the abutment are provided on said lid part.

9. A dispenser according to claim 1 wherein the tapered guide means comprises a tapered roller rotatable about an axis which extends away from the engagement portion and over which the tape is passed.

10. A dispenser according to claim 9 wherein the roller is of smaller diameter at the end of the roller which is closer to the engagement portion.

11. A dispenser according to claim 1 wherein the body is provided with two sets of said guide means and guide surface at opposite ends of the body so that the tape may be dispensed, alternately, from opposite ends of the body.

* * * * *

UNITED STATES PATENT AND TRADEMARK OFFICE

CERTIFICATE OF CORRECTION

PATENT NO. : 5,562,262

DATED : October 8, 1996

INVENTOR(S) : Jack F. Pennell

It is certified that error appears in the above-indentified patent and that said Letters Patent is hereby corrected as shown below:

Column 2 Line 53 "5;is" should read --5 is--.

Column 3 Line 16 "material is" should read --material. As--.

Claim 1 Line 13 Column 5 "resilient" should read --resiliently--.

Claim 4 Line 6 Column 6 before "dispenser" insert --A--.

Signed and Sealed this

Seventeenth Day of December, 1996

*Attest:*

Bruce Lehman

BRUCE LEHMAN

*Attesting Officer*

*Commissioner of Patents and Trademarks*